US011705659B2

(12) United States Patent
Sundarakrishnamachari et al.

(10) Patent No.: US 11,705,659 B2
(45) Date of Patent: Jul. 18, 2023

(54) SPLIT HOUSING WITH INTEGRATED TERMINAL POSITION ASSURANCE AND INDEPENDENT SECONDARY LOCK FEATURES

(71) Applicant: Aptiv Technologies Limited, St. Michael (BB)

(72) Inventors: Rangarajan Sundarakrishnamachari, Chennai (IN); Sivakumar Jogula, Nagarkumool (IN)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 139 days.

(21) Appl. No.: 17/075,123

(22) Filed: Oct. 20, 2020

(65) Prior Publication Data

US 2022/0123495 A1 Apr. 21, 2022

(51) Int. Cl.
*H01R 13/436* (2006.01)
*H01R 43/18* (2006.01)
*H01R 43/20* (2006.01)

(52) U.S. Cl.
CPC ..... *H01R 13/4368* (2013.01); *H01R 43/18* (2013.01); *H01R 43/20* (2013.01)

(58) Field of Classification Search
CPC ..... H01R 13/4538; H01R 13/4362; H01R 13/4223; H01R 13/62938; H01R 13/426; H01R 13/4364; H01R 13/4365; H01R 13/502; H01R 13/506; H01R 13/516; H01R 13/5208; H01R 13/521; H01R 13/6271; H01R 13/64
See application file for complete search history.

(56) References Cited

U.S. PATENT DOCUMENTS

| | | | | |
|---|---|---|---|---|
| 7,267,562 | B2 * | 9/2007 | Katsuma | H01R 13/516 439/140 |
| 8,038,455 | B1 * | 10/2011 | Moraes | H01R 13/4538 439/140 |
| 9,147,958 | B2 * | 9/2015 | Kuroda | H01R 13/4362 |
| 9,887,490 | B2 * | 2/2018 | Matsuura | H01R 13/6271 |
| 10,079,446 | B1 * | 9/2018 | Sundarakrishnamachari | H01R 13/4364 |
| 10,177,486 | B2 * | 1/2019 | Kobayashi | H01R 13/5208 |
| 10,498,066 | B1 * | 12/2019 | Sundarakrishnamachari | H01R 13/426 |
| 10,763,610 | B2 * | 9/2020 | Bae | H01R 13/502 |

FOREIGN PATENT DOCUMENTS

JP 3869631 B2 * 1/2007

* cited by examiner

*Primary Examiner* — Jean F Duverne
(74) *Attorney, Agent, or Firm* — Billion & Armitage

(57) ABSTRACT

A split housing connector assembly provides integrated terminal position assurance and an independent secondary lock and includes a nosepiece and a rear housing. In a pre-lock configuration, a plurality of wire terminal bays are aligned to allow insertion of wire terminals and wherein in a locked configuration the rear housing is displaced relative to the nosepiece offsetting the wire terminal bays and blocking removal of the wire terminals. The rear housing engages the nosepiece along a cam track to guide relative movement during assembly.

22 Claims, 17 Drawing Sheets

SPLIT HOUSING WITH INTEGRATED TERMINAL POSITION ASSURANCE AND INDEPENDENT SECONDARY LOCK FEATURES

BACKGROUND

This disclosure is generally directed to the art of electrical connectors and, more particularly, to an electrical connector assembly which includes a terminal position assurance feature and an independent secondary lock.

A common type of electrical connector includes a dielectric housing having a plurality of terminal-receiving cavities within which are mounted a plurality of terminals. The terminals typically terminate an insulated wire and may be formed metal components. The terminals include a mating end for mating with terminals of a complementary electrical connector assembly. The terminals must be properly positioned within their respective housing cavities for proper mating with the terminals of the complementary connector assembly.

Improper installation of electrical connectors has long been a problem in mating connector assemblies. The mating assemblies may perform quite adequately under normal circumstances, but open circuits or other defects can occur when the terminals are not properly positioned within the housings of the connector assemblies or when the assemblies are not properly mated. In addition, use of the connectors in vibration environments can cause the terminals to become loosened and rendered defective. In many environments improper retention of the terminals can result in unstable electrical interconnections which can be difficult to detect or diagnose.

Various designs have been used to improve the retention of terminals within electrical connector housings and to improve the mating integrity of the connector assemblies themselves. For example, terminal latches integral with the connector housing often are used to enhance the mating integrity between the connectors. Regardless of the integrity between the connector housings themselves, if the terminals are improperly positioned within each housing, open circuits or terminal damage can occur even though the connector housings appear to be properly mated. Therefore, various devices have been designed to protect against improperly positioned terminals and, in fact, to prevent the connector assemblies from mating unless all of the terminals therewithin are properly positioned. Such devices commonly have been called "terminal position assurance" (TPA) devices.

A known terminal position assurance system utilizes an elongated terminal position assurance (TPA) device extendable longitudinally through the housing. If any one of a plurality of terminals is not in its fully inserted position, movement of the TPA device is blocked and it cannot be extended longitudinally through the housing, thereby indicating terminal positioning problems. In various applications of electrical connectors, devices are utilized to lock the terminals in place and to assure that they are in proper position within the electrical connector. One such example is in the automotive field where a terminal position assurance mechanism (TPA) assures that the terminals are in proper position longitudinally within the respective cavities. This prevents an improper mating of a corresponding electrical connector, where some of the lines are open due to one or more terminals not being properly positioned.

Typical TPAs are intended to be activated, or moved into their final position, after the terminals are assembled into the housing. Traditionally, these connectors are shipped in bulk to the end user, where the wire harnesses are made, wires crimped to the terminals, and terminals inserted into the housing cavities. Thereafter, the TPA member is moved into the final position.

In other examples, electrical connectors are provided with housings having cavities extending therethrough for receiving wire terminals, each cavity/terminal pair provided with a resilient locking latch integrally molded with the housing for locking a terminal inserted therein. In order to further secure the terminals within the housing, it is common to provide an independent secondary housing member that is moveable to prevent the wire terminals from being removed (commonly referred to as "secondary lock members"). In some examples the locking latches are locked into their latched position.

It is also known to provide the secondary lock in a pre-assembly position that allows insertion of the terminals into the connector cavities. The secondary lock can then be moved to a fully locked position whereby the terminals are locked in the cavities. The secondary lock assemblies are typically side-loaded (in a direction orthogonal to a longitudinal direction of the terminals) and result in relatively bulky assemblies and more complex and costly tooling.

One of the shortcomings of present independent secondary lock designs is that they are designed with side-loading components that require side-openings in the terminal housing. Such side openings lead to increased tooling complexity and component cost. Furthermore, side access secondary lock designs limit placement and layout of multi-terminal systems as each terminal assembly requires additional displacement relative to neighboring terminals to allow access to the side-loaded ISL.

SUMMARY

According to one aspect, an electrical connector is provided with integrated terminal position assurance (TPA) and independent secondary lock (ISL) features. The electrical connector includes a multicomponent housing. In one example, the housing includes a front nose piece and a rear housing adapted to be received into the nose piece.

According to another aspect, a split housing is provided with independent secondary lock feature that reduces assembly complexity. In one example, side-loading of an ISL is eliminated as the secondary lock functions of embodiments of the present invention are activated at the rear side of the terminal with a lock force applied in a longitudinal (mating) direction of the connector.

According to yet another aspect, a split housing is provided with simultaneous translation of housing components in an axial mating direction and an orthogonal direction perpendicular to the mating direction actuated by means of a cam structure.

According to yet another aspect, a split housing functions to guide, locate and move an improperly loaded terminal into its intended final orientation.

According to another aspect, a split housing is provided with manually actuatable locks that provide positive lock set up for the split housing. In comparison to the prior art ISL teachings having side-engaged locks, the ISL function of a split housing in accordance with an embodiment of the present invention is actuated from the rear side along the mating direction.

DETAILED DESCRIPTION

According to one aspect, this disclosure is directed to a connector assembly and method of utilizing the connector assembly to provide terminal position assurance and an independent secondary lock for securing wire terminals.

Embodiments of the present disclosure generally provide for a connector assembly and methods of use. All references to the connector assembly components and the functionality provided by each, are not intended to be limited to encompassing only what is illustrated and described herein. While particular labels may be assigned to the various structures disclosed, such labels are not intended to limit the scope of operation for the connector assembly.

The present teachings are directed toward a connector assembly with terminal position assurance (TPA) and independent secondary lock ("ISL") features to ensure all terminals are properly positioned during assembly and remain properly positioned and secured during intended use. The present teaching is directed to a connector having TPA features that appropriately bias improperly positioned terminals into correct alignment, and an ISL structure that generally acts to prevent withdrawal of the wire terminals from the connector in response to external forces and in the event of primary lock failure, as will be discussed in further detail.

In general terms, the connector assembly can couple with a mating connector to allow for the transfer of electrical signals therebetween, such as for transferring power and/or information signals for example. While electrical terminals are described, it is also contemplated that the terminals and any cables connected thereto may be capable of transferring information in other ways, such as through fiber optic connections for example.

A first exemplary embodiment of a connector assembly 10 including terminal position assurance (TPA) and an independent secondary lock (ISL) function of the present invention is hereinafter described with reference to FIGS. 1-11.

Figure 1:
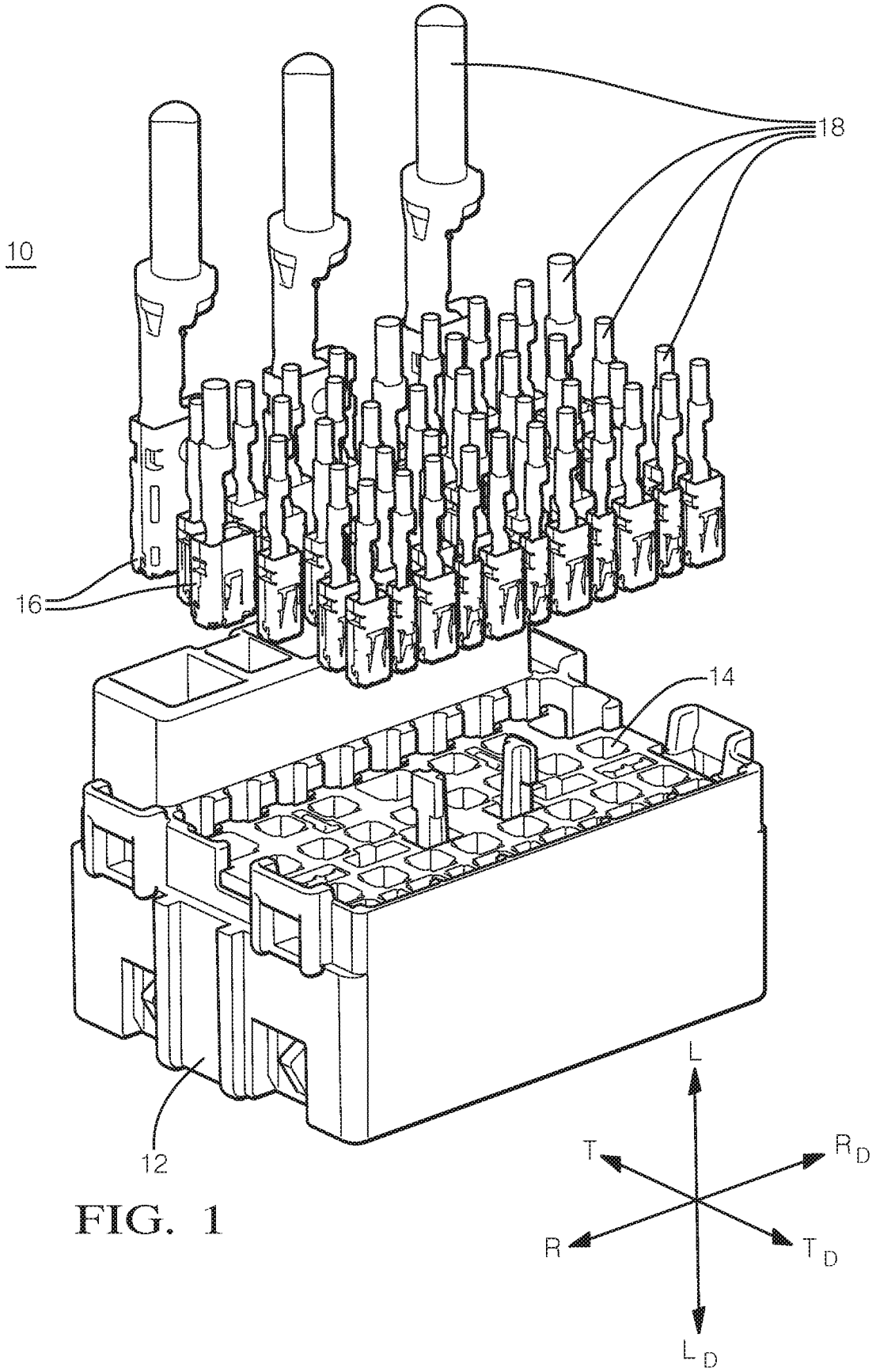
FIG. 1 is a perspective illustration of a connector assembly according to some embodiments.

FIG. 1 is a perspective view of a partially assembled connector assembly 10. The connector assembly 10 includes a split, two-part connector housing including a nosepiece 12 and a rear housing 14. The nosepiece 12 is configured to mate with the rear housing 14 to allow for electrical connections to be made between terminals 16 attached to wires 18 inserted into the nosepiece 12 and rear housing 14.

For simplicity of the description of the present invention, the nosepiece 12 and rear housing 14 extend along and about a longitudinal axis L which defines a longitudinal direction LD (the mating direction), a lateral axis R defines a lateral direction RD and a transverse axis T defines a transverse direction TD. The longitudinal axis L, the lateral axis R and the transverse axis T perpendicularly intersect one another to form a conventional Cartesian coordinate system.

Figure 2:
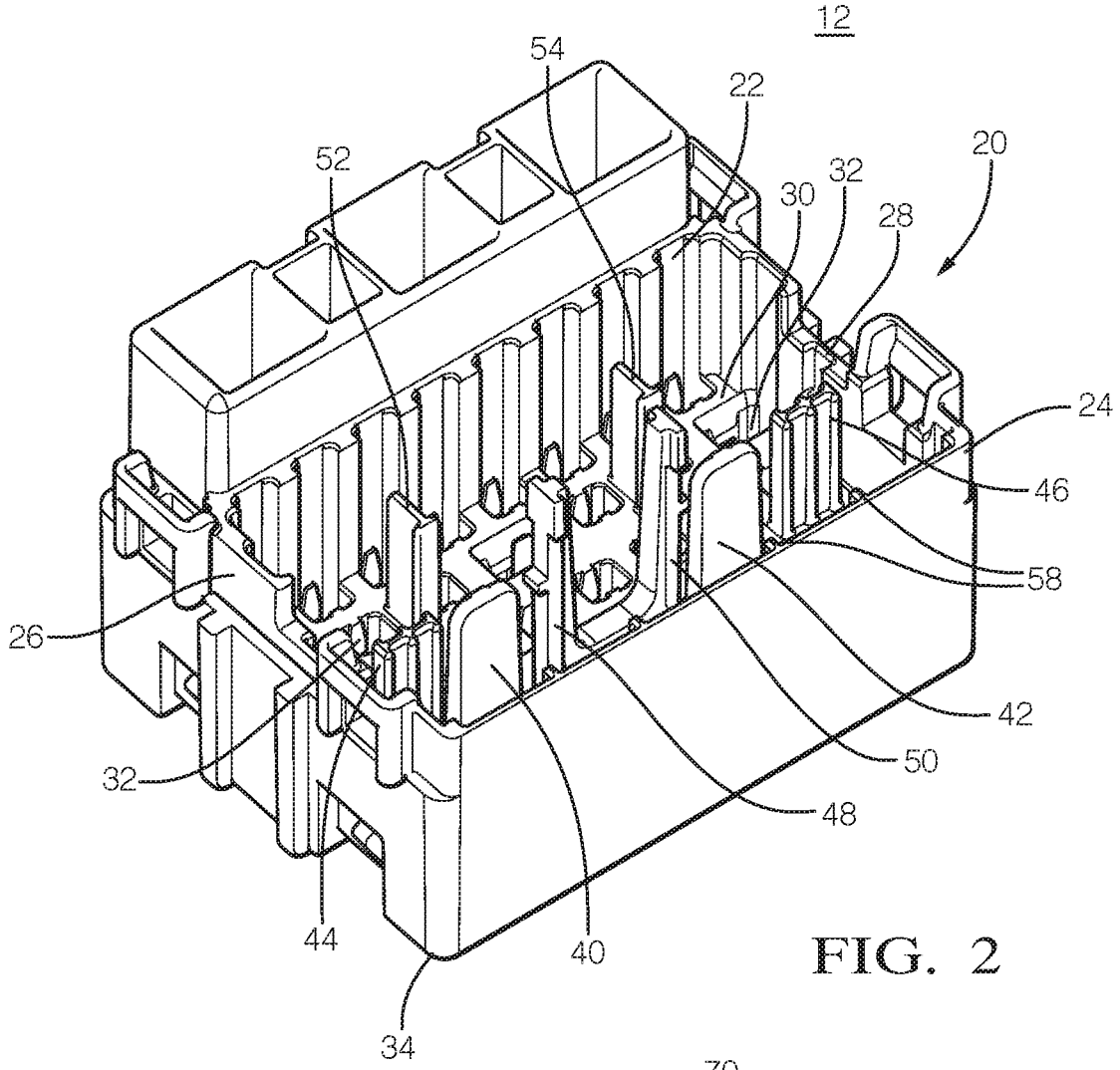
FIG. 2 is a perspective view of a nosepiece housing of the connector assembly of FIG. 1 according to some embodiments.

FIG. 2 is a perspective view of nosepiece 12 showing a cavity 20 for receiving rear housing 14. Cavity 20 is generally defined within a pair of transverse side walls 22, 24 and a pair of lateral side walls 26, 28. An intermediate surface 30 of cavity 20 includes openings into multiple terminal cavities, referred to herein as a first plurality of wire terminal bays 32, for receiving portions of wire terminals 16 inserted as described in detail hereinafter. The terminal bays 32 are open at a forward surface 34 of nosepiece 12 to allow terminal connections between connector assembly 10 and a mating connector (not shown).

Nosepiece 12 includes a plurality of functional posts adapted to engage with rear housing 14 during assembly. In the illustrated embodiment the posts extend rearwardly from the intermediate surface 30 of nosepiece 12. In other examples, the posts may be side-wall mounted. In the embodiment of FIG. 2, the posts include a pair of flexing pre-stage latch posts 40, 42, a pair of alignment posts 44, 46, a pair of flexing lock posts 48, 50, and a pair of T-rib alignment posts 52, 54. The interaction between the pre-stage latch, alignment, lock, and T-rib alignment posts 40, 42, 44, 46, 48, 50, 52, 54 and the rear housing 14 will be described in detail hereinafter. In short, pre-stage latch posts 40, 42 and lock posts 48, 50 primarily function to maintain the nosepiece 12 and rear housing 14 in either a pre-stage configuration or locked configuration, while alignment and T-rib alignment posts 44, 46, 52, 54 assist in positioning and guiding relative movement between the nosepiece 12 and rear housing 14. Nosepiece 12 also includes rail-like nosepiece stabilizers 58 extending inwardly from an interior surface of transverse wall 24 which engage the rear housing 14 and assist with alignment during assembly.

Figure 3:
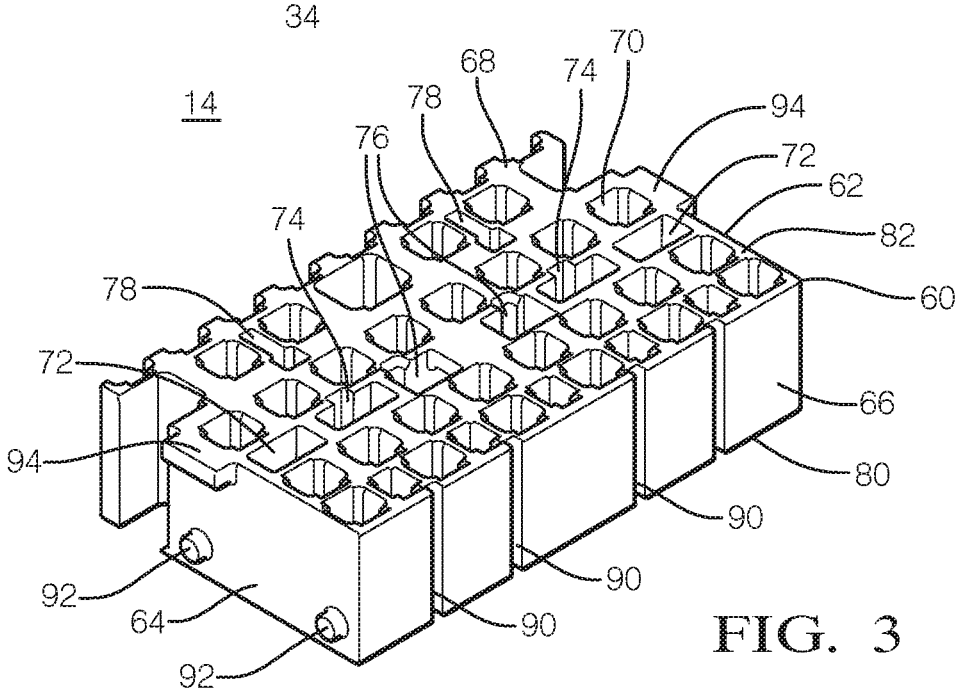
FIG. 3 is a perspective view of a rear housing of the connector assembly of FIG. 1 according to some embodiments.

FIG. 3 is a perspective view of rear housing 14 showing a body 60 defined between a pair of lateral sides 62, 64 and transverse sides 66, 68. A plurality of open cavity bays 70, 72, 74, 76, 78 extend from a forward surface 80 to a rearward surface 82 of body 60. The second plurality of wire terminal bays 70 are adapted to receive a wire terminal 16 while bays 72, 74, 76 are adapted to receive one of the pre-stage latch, alignment, lock, and T-rib alignment posts 40, 42, 44, 46, 48, 50, 52, 54 of nosepiece 12. Body 60 further includes stabilizer grooves 90, cam posts 92 and positioning tabs 94. During assembly of the connector assembly 10, stabilizer grooves 90 of rear housing 14 engage nosepiece stabilizers 58 to assist in alignment and component assembly. Cam posts 92 engage cam tracks 100 (shown in FIG. 4) in nosepiece 12 to control relative movement between nosepiece 12 and rear housing 14 as described in more detail hereinafter. Positioning tabs 94 allow for easier finger manipulation of rear housing 14, particularly when biasing in mating directions during assembly or terminal removal.

Figure 4:
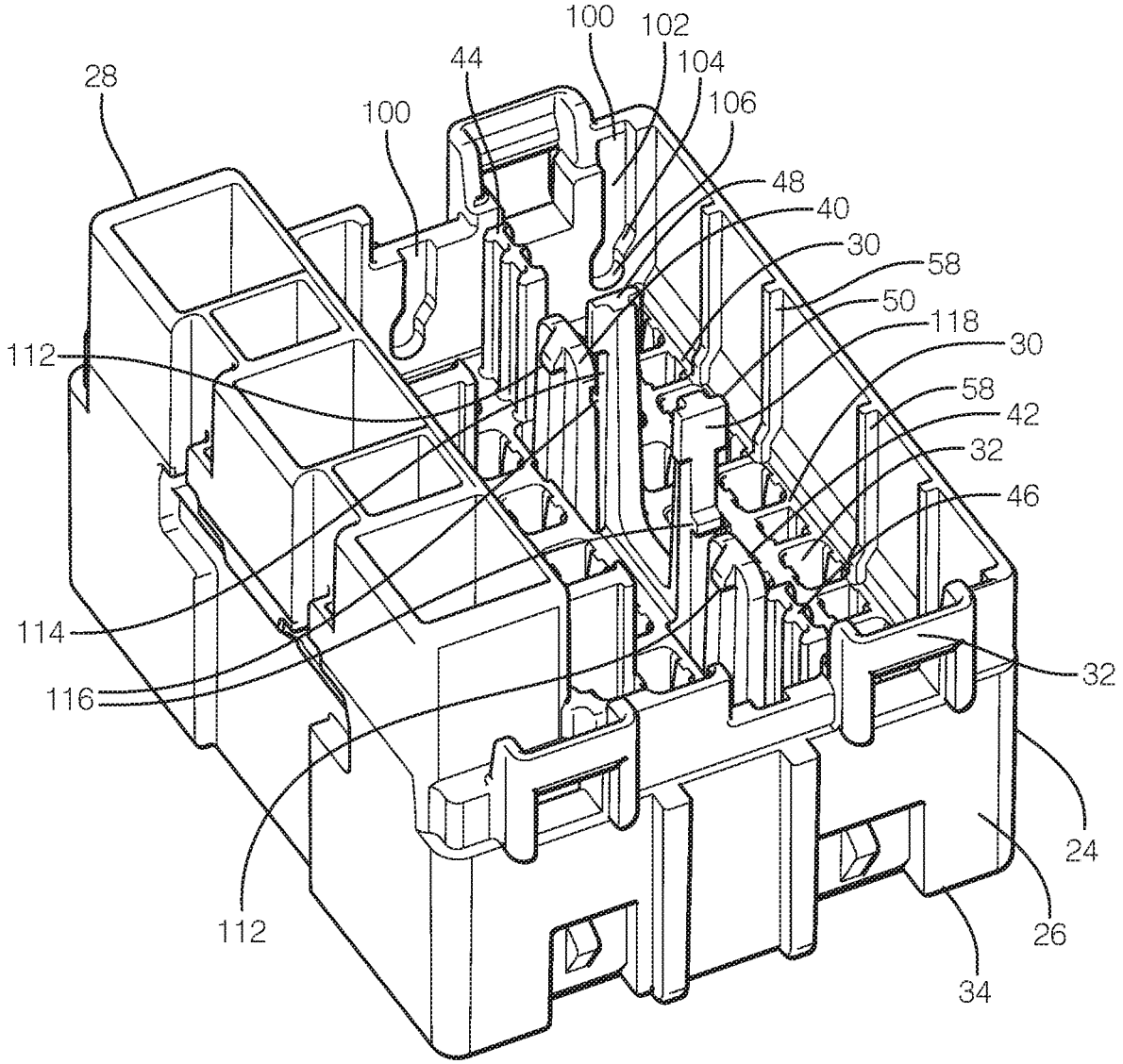
FIGS. 4-5 are perspective views of the nosepiece of FIG. 2 according to some embodiments.
Figure 5:
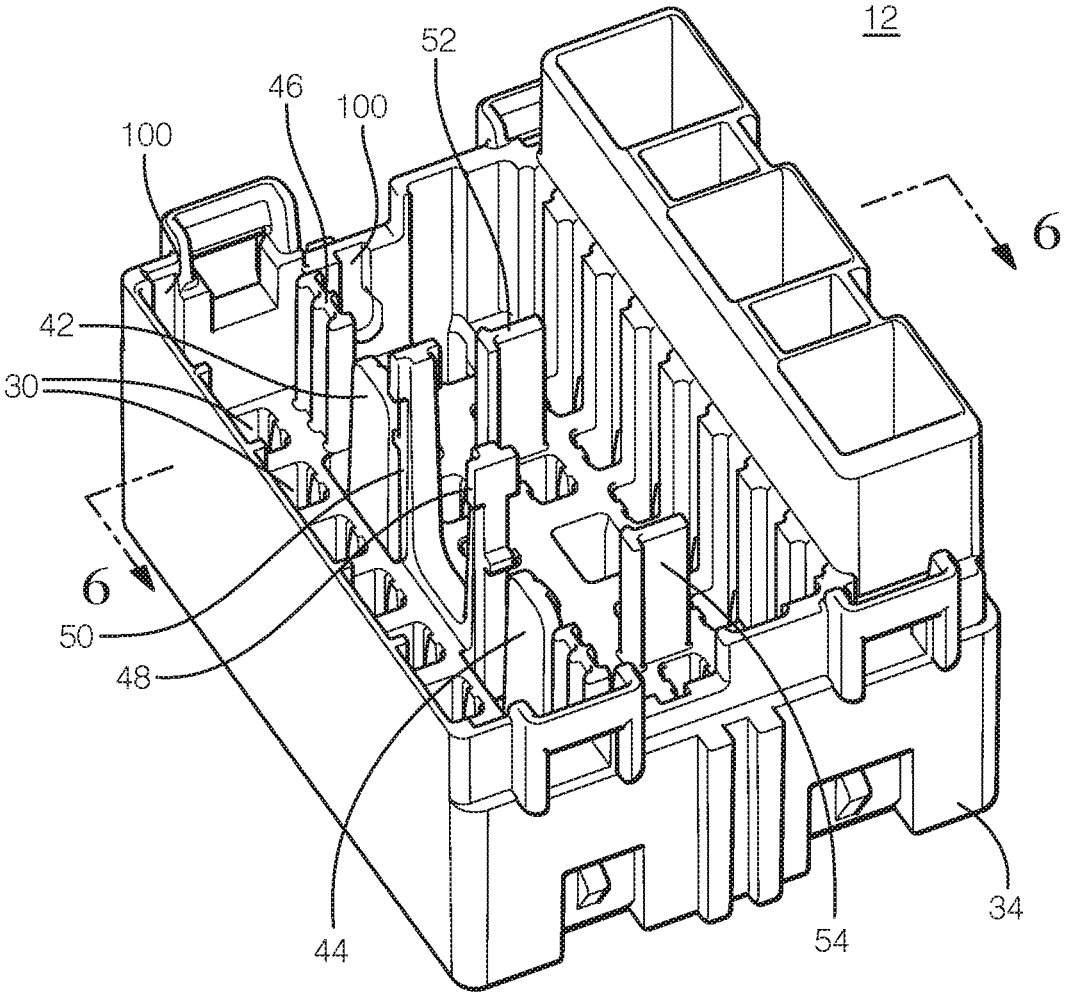
Figure 6:
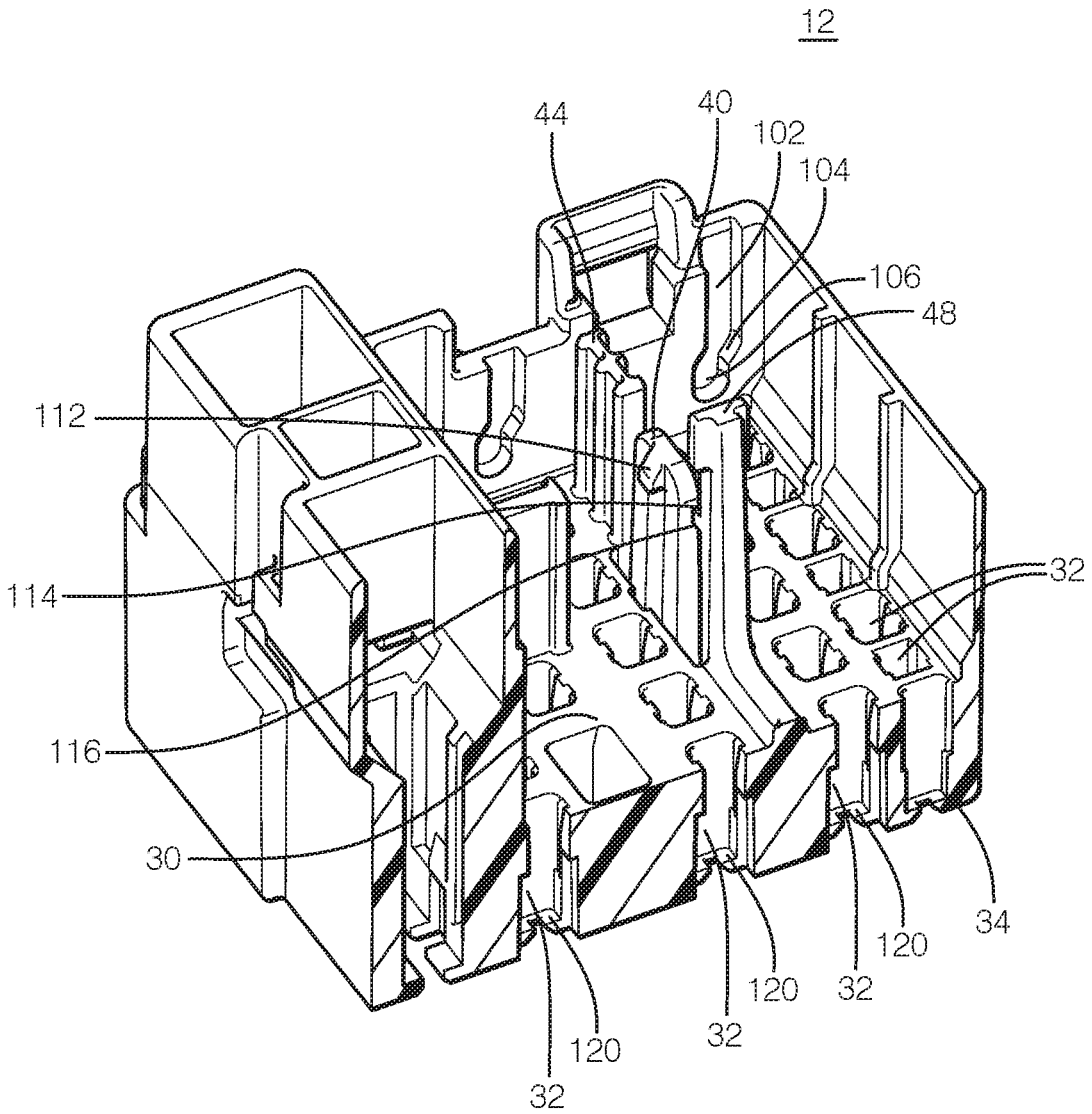
FIG. 6 is a cross-sectional perspective view of the nosepiece taken along lines 6-6 of FIG. 5 according to some embodiments.

FIG. 4-FIG. 6 are perspective views of nosepiece 12 showing cam tracks 100 defined as grooves or channels on interior surfaces of lateral side walls 26, 28. Cam tracks 100 each include a generally elongated linear portion 102, a cam portion 104, and a final offset portion 106. Portion 106 is offset in a direction orthogonal to a longitudinal (mating) direction of the connector assembly 10 so that the cam tracks 100 bias the rear housing 14 in the orthogonal direction prior to final stage configuration. Cam tracks 100 are open at an upper end of linear portion 102 to allow insertion of the cam posts 92 of rear housing 14.

Cam tracks 100 and cam posts 92 are sized to allow a slidable coupling between the rear housing 14 and nosepiece 12 during assembly. As will be described in greater detail hereinafter, the cam posts 92 of rear housing 14 are constrained within the cam tracks 100 to allow motion of the rear housing 14 initially in only a longitudinal (mating) direction and then in an orthogonal direction as the cam posts 92 traverse along the cam tracks and engage cam portion 104. In this embodiment of the invention, cam tracks 100 are shown as two pair of configured channels with generally rectangular cross-sectional profiles. In other embodiments, cam tracks 100 could assume alternative configurations. In yet other embodiments, cam tracks 100 and cam posts 92 could be swapped to reside on rear housing 14 and nosepiece 12, respectively.

FIG. 4-FIG. 6 also illustrate lock surfaces 112 on pre-stage latch posts 40, 42, and upper and lower lock surfaces 114, 116 on lock posts 48, 50. Lock surfaces 112, 114, 116 engage cooperating lock surfaces on rear housing 14 to lock the nosepiece 12 and rear housing 14 in pre-stage and final stage (locked) configurations. In one example, lock posts 48, 50 can be manipulated (flexed) to decouple the nosepiece 12 and rear housing 14 by biasing the cantilevered ends of lock posts 48, 50 with finger pressure in a direction toward each other. In the illustrated embodiment, the cantilevered ends of posts 48, 50 define press pads 118 adapted to be finger manipulated during connector assembly/disassembly. In one example, lock posts 48, 50 are of suitable length to extend past the rear of rear housing 14 to be accessible for release or other manipulation from behind the connector assembly.

FIG. 6 illustrates additional details of terminal bays 32 adapted to receive wire terminals 16. The terminal bays 32 extend forwardly from intermediate surface 30 to forward surface 34 of nosepiece 12. A stop surface 120 defines a forward limit for the wire terminals 16. A front (mating) end of each terminal 16 engages stop surface 120 when properly positioned.

Figure 7:
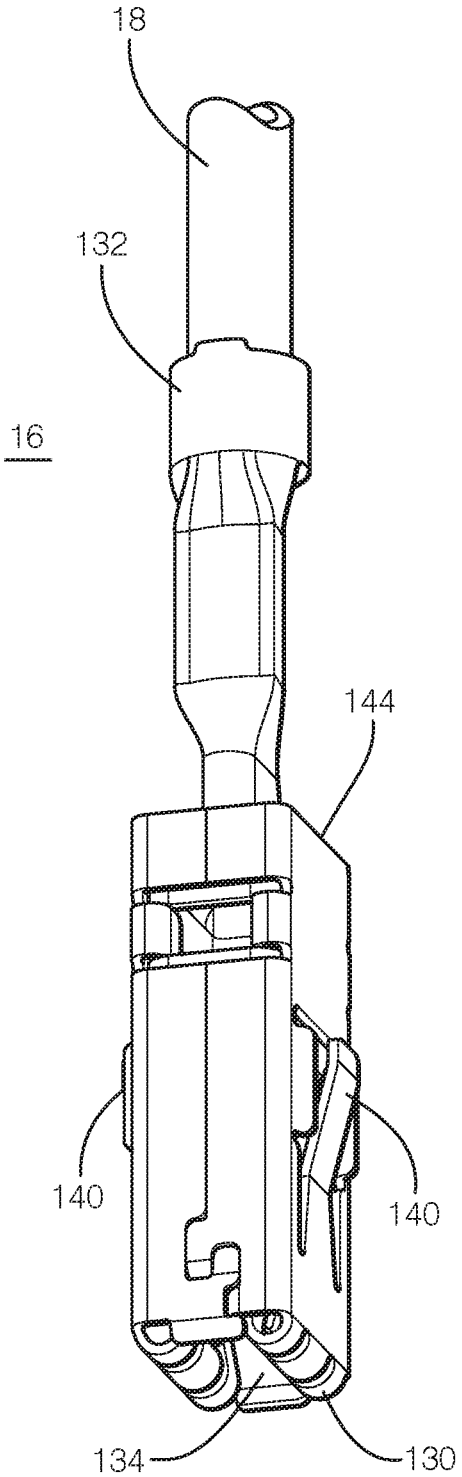
FIGS. 7-8 are perspective views of wire terminals of the connector assembly of FIG. 1 according to some embodiments.
Figure 8:
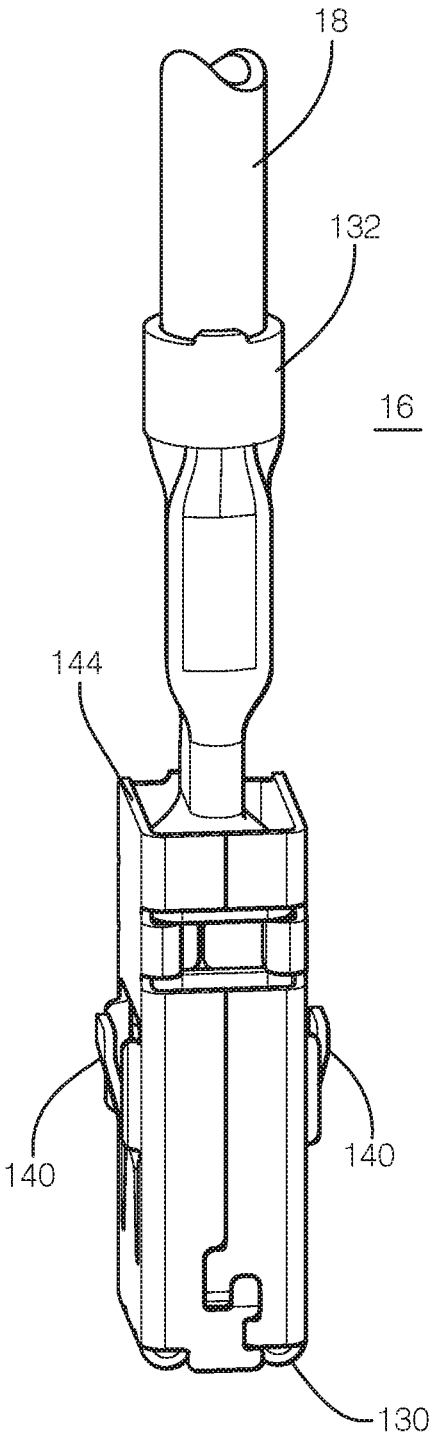

FIGS. 7 and 8 are perspective views of one embodiment of a wire terminal 16 suitable for use with the illustrated embodiment of the connector assembly 10. The terminals 16 can be electrically coupled to wires 18. Each terminal 16 includes a mating end 130 and a wire terminating end 132. The mating end 130 includes an opening 134 into which a male portion of a corresponding terminal (not shown) is received. As mentioned, the mating end 130 is intended to engage stop surface 120 of nosepiece 12 when properly positioned. The terminals 16 include a pair of locking members 140 that cooperate with locking structure within each bay 32 to secure the terminal 16 to the nosepiece 12. In the exemplary embodiment the locking members 140 represent spring latch arms extending outwardly from the terminal main body. Each wire terminal 16 also includes a biasing/locking surface 144 positioned between the mating end 130 and the wire terminating end 132. During assembly, contact is made from the rear housing 14 at locking surface 144 on any improperly positioned terminals 16 to bias the terminals 16 into a desired final position. For example, in a terminal position assurance process, rear housing 14 engages the biasing/locking surfaces 144 of any improperly positioned terminals 16 and biases these terminals 16 in a mating direction to properly position terminal mating ends 130 in a common plane. After assembly, and when the connector is in a final stage configuration, these biasing/locking surfaces 144 engage the rear housing 14 to resist a pull-out force, such as when a wire terminal 16 is pulled rearwardly.

An exposed portion of one of the wires 18 is terminated to the wire terminating end 132 by a crimping process. Alternatively, another terminating process, such as a soldering process or insulation displacement process may be used. In the exemplary embodiment, the terminal 16 represents a crimp/snap style contact that is attached to a wire via a crimping process and snappably retained within a bay 32 of the connector via locking members 140. In the illustrated embodiment, the wire terminal 16 is loaded into bays 32, 70 after the wire terminal 16 is crimped to wire 18. In the exemplary embodiment, the terminals 16 are intended to be substantially aligned within the bays 32, 70 such the wire terminals 16 can be inserted into bays 32, 70 of rear housing 14 and nosepiece 12 without interference. A properly positioned terminal 16 results in the mating end 130 of the terminals 16 arranged along a common plane (e.g., the plane containing stop surfaces 120).

Figure 9:
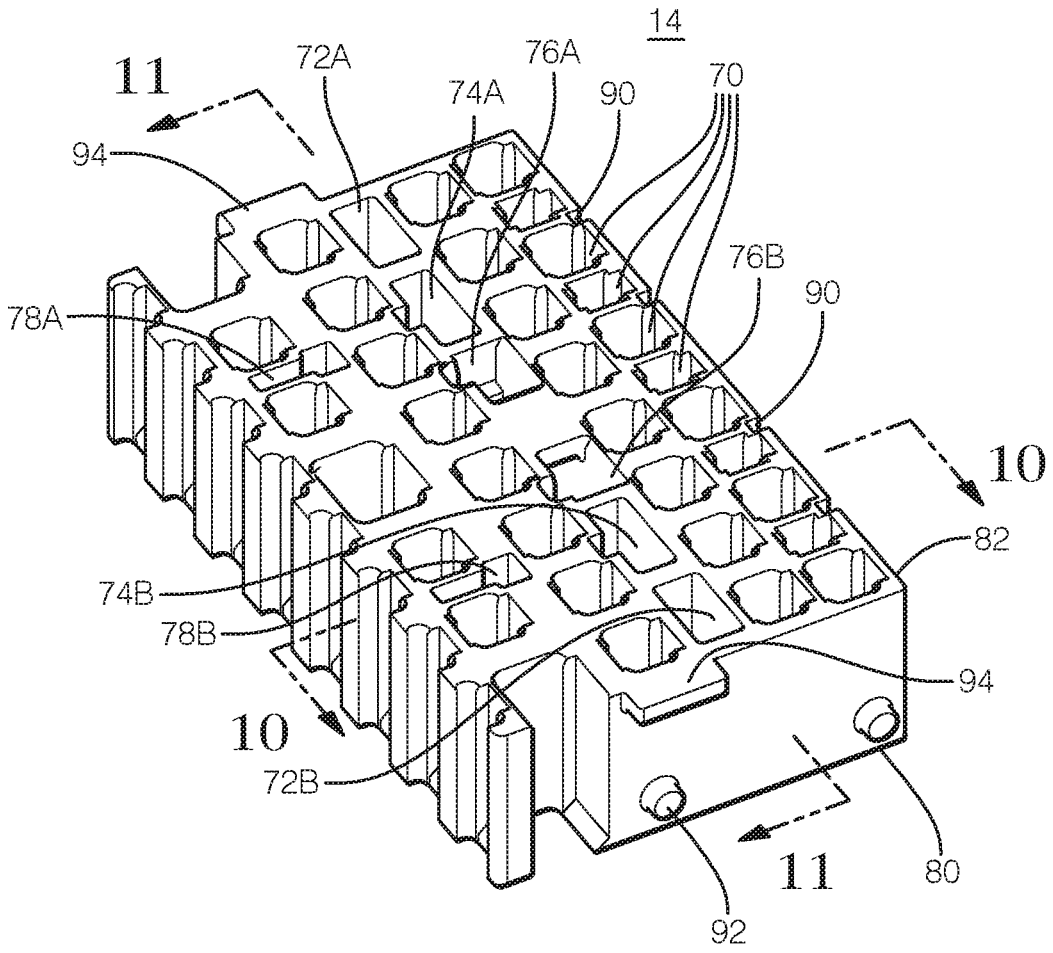
FIG. 9 is a perspective view of a rear housing of the connector assembly of FIG. 1 according to some embodiments.
Figure 10:
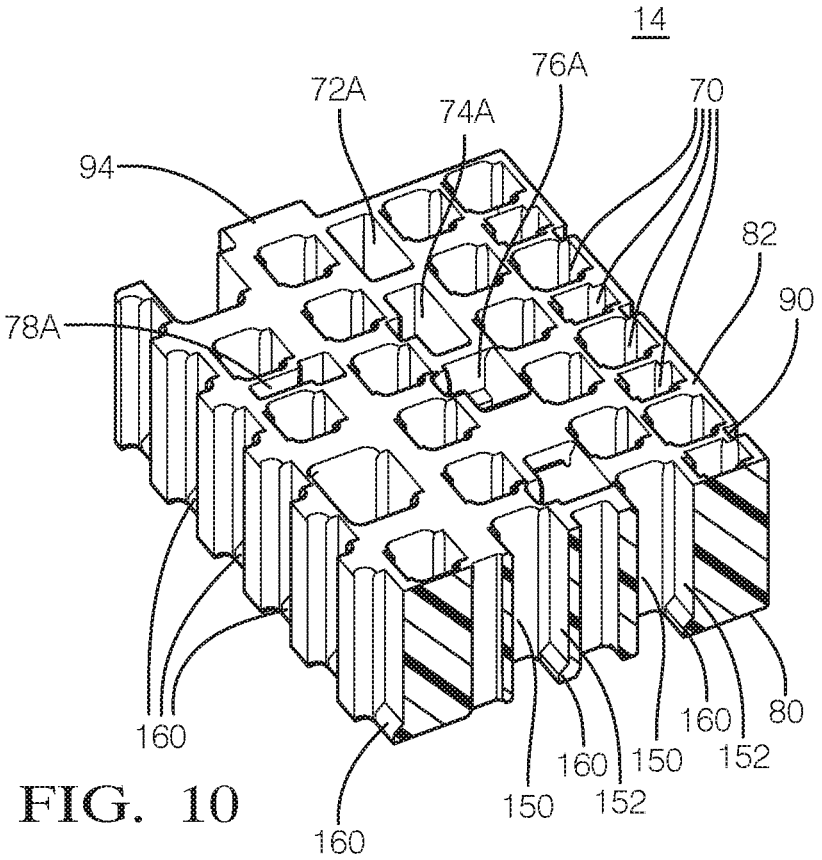
FIG. 10 is a cross-sectional perspective view of the rear housing taken along lines 10-10 of FIG. 9 according to some embodiments.
Figure 11:
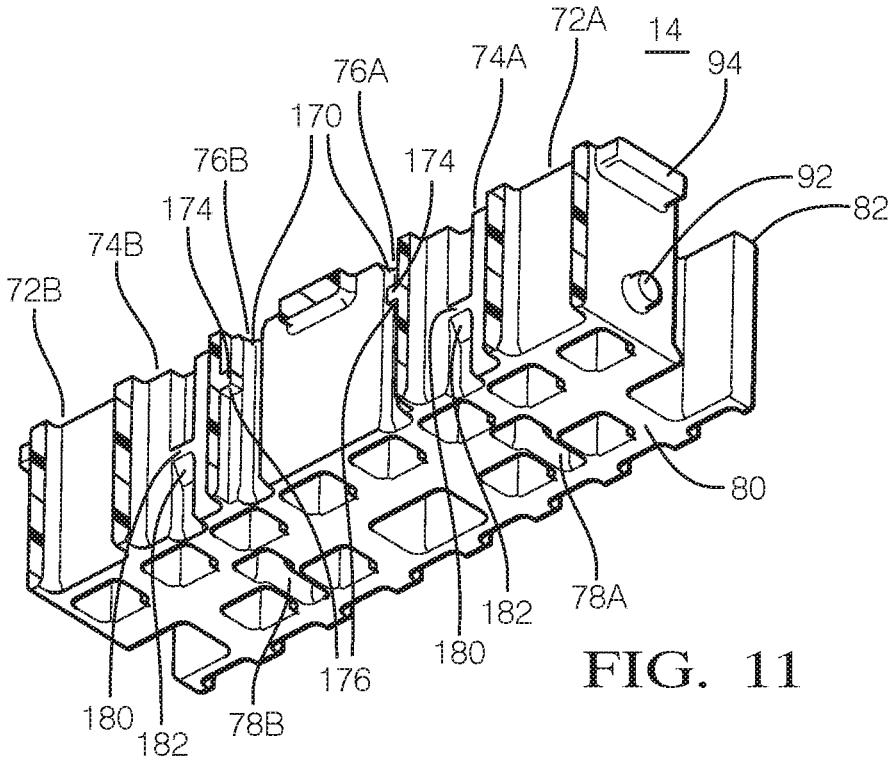
FIG. 11 is a cross-sectional perspective view of the rear housing taken along lines 11-11 of FIG. 9 according to some embodiments.

FIGS. 9-11 illustrate additional aspects of rear housing 14 in accordance with the embodiment of FIG. 1. FIG. 9 is a perspective illustration of rear housing 14 generally showing a matrix of wire terminal bays 70, pre-stage latch post bays 74A, 74B, alignment post bays 72A, 72B, lock post bays 76A, 76B, and T-rib alignment post bays 78A, 78B.

FIG. 10 is a cross-sectional view of the rear housing 14 taken along lines 10-10 of FIG. 9. In the illustrated embodiment, each wire terminal bay 70 include an open, elongated square-profile volume 150 sized to receive the generally elongated square-profile body of the terminal 16 and a smaller open-ended offset volume 152 positioned adjacent to the square-profile volume 150. The open-ended offset volume 152 extends longitudinally into nosepiece 12 from rearward surface 82 to a locking foot 160 positioned at the opposite forward surface 80 of rear housing 14. A flat lower surface of locking feet 160 engage biasing/locking surfaces 144 of terminals 16. Locking feet 160 include a chamfer opposite the flat lower surface to minimize terminal snubbing during terminal insertion at pre-stage assembly. As described in greater detail herein, the locking feet 160 at a forward end of the rear housing 14 engage any misaligned wire terminals 16 (at biasing/locking surface 144) to bias these terminals 16 into proper position during assembly. In the final stage configuration, the locking feet 160 block the terminals 16 and define an independent secondary lock designed to eliminate unintended terminal 16 pull-out.

FIG. 11 is a cross-sectional view of the rear housing 14 taken along lines 11-11 of FIG. 9. A pair of tabs 170 extending into lock post bays 76A, B define upper and lower lock surfaces 174, 176. When connector assembly 10 is in a pre-stage configuration, lock surfaces 176 engage lock surface 114 of the nosepiece 12. Subsequently when the rear housing 14 is further biased into the nosepiece 12 toward a final stage configuration, lock surfaces 174 engage lock surface 116 of the nosepiece 12. Other lock surfaces 180 are defined within pre-stage latch bays 74A, B. Inclined ramp features 182 leading to lock surfaces 180 interact and deflect pre-stage latch posts 40, 42 during assembly.

Figure 12A:
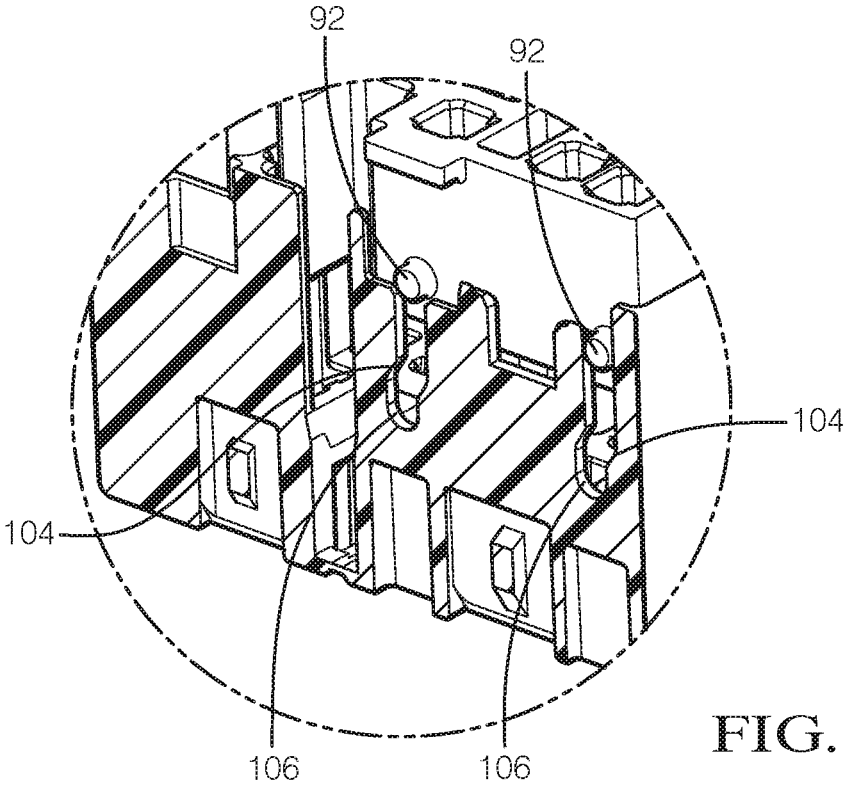
FIGS. 12A, B, C, are detailed views of a portion of the connector assembly of FIG. 1 according to some embodiments.
Figure 12B:
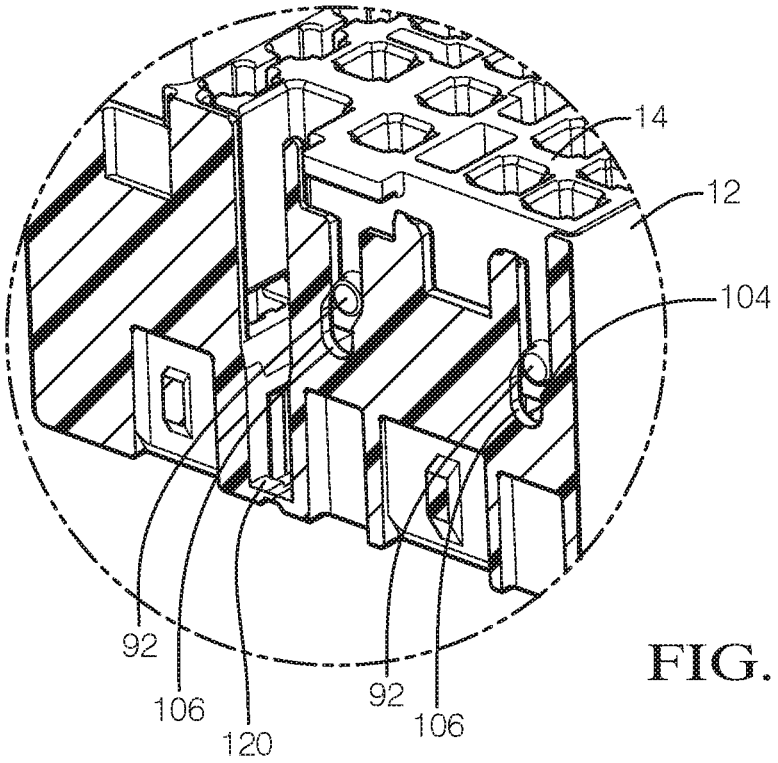
Figure 12C:
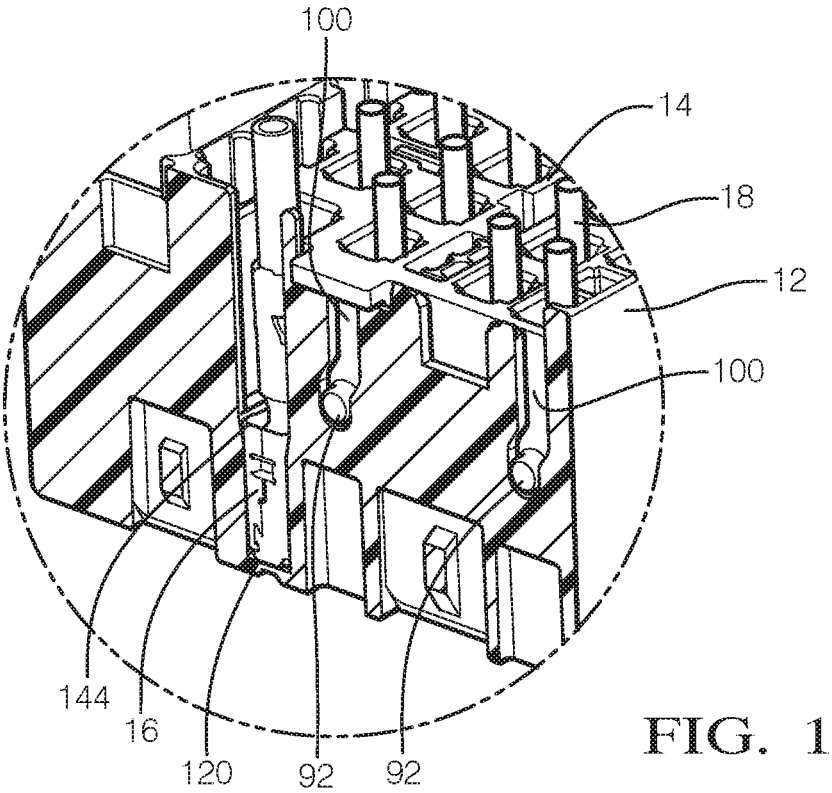

Additional details of methods of using the connector assembly of FIGS. 1-11 are illustrated in FIGS. 12-14. FIGS. 12A-C illustrate the transition of connector assembly components between pre-stage and final stage configurations, particularly the cam post 92/cam track 100 interaction. FIG. 12A illustrates the rear housing 14 upon initial insertion into cavity 20 of nosepiece 12. Cam posts 92 are shown as entering the cam track 100. FIG. 12B illustrates the rear housing 14 in a "pre-stage" configuration with the rear housing having traversed the linear portion of cam track 100. The rear housing 14 and nosepiece 12 are held in the pre-stage configuration by operation of the pre-stage latch posts 40, 42 and lock posts 48, 50. In one example, wire terminals 16 are inserted into the bays 32, 70 when the components are in the pre-stage configuration. FIG. 12C illustrates the rear housing 14 in a final stage configuration where the cam posts 92 have traveled to ends of cam tracks 100. In the final stage configuration, rear housing 14 has transitioned in a direction orthogonal to the mating direction. To transition from the pre-stage configuration to the final lock configuration, lock posts 48, 50 are biased toward each other by applying inwardly directed forces between press pads 118 and simultaneously applying a force in the mating direction to further move the rear housing 14 into the nosepiece 12.

Figure 13A:
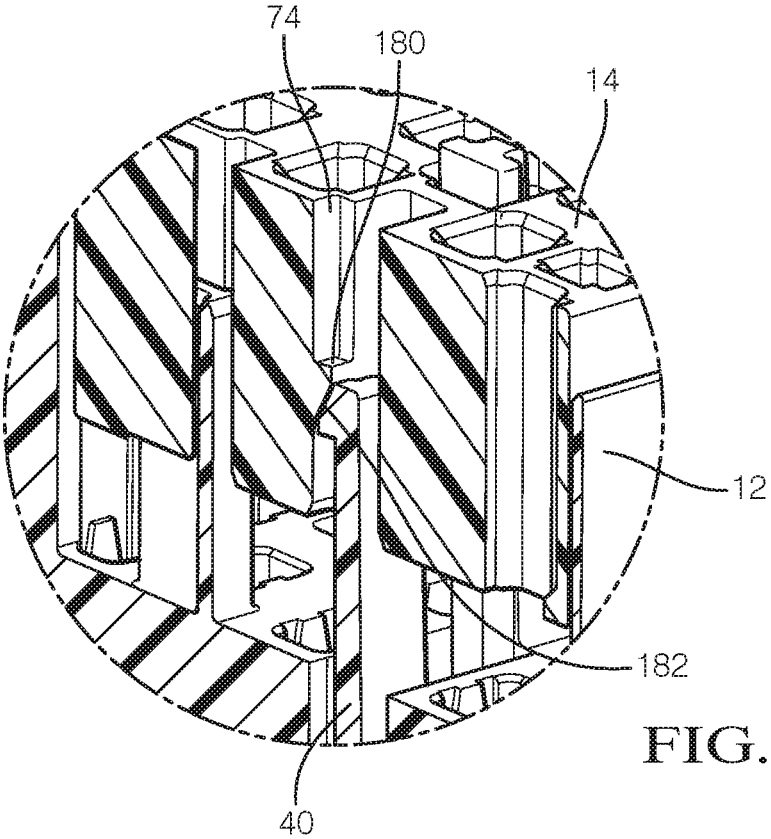
FIGS. 13A, B, C, are detailed views of a portion of the connector assembly of FIG. 1 according to some embodiments.
Figure 13B:
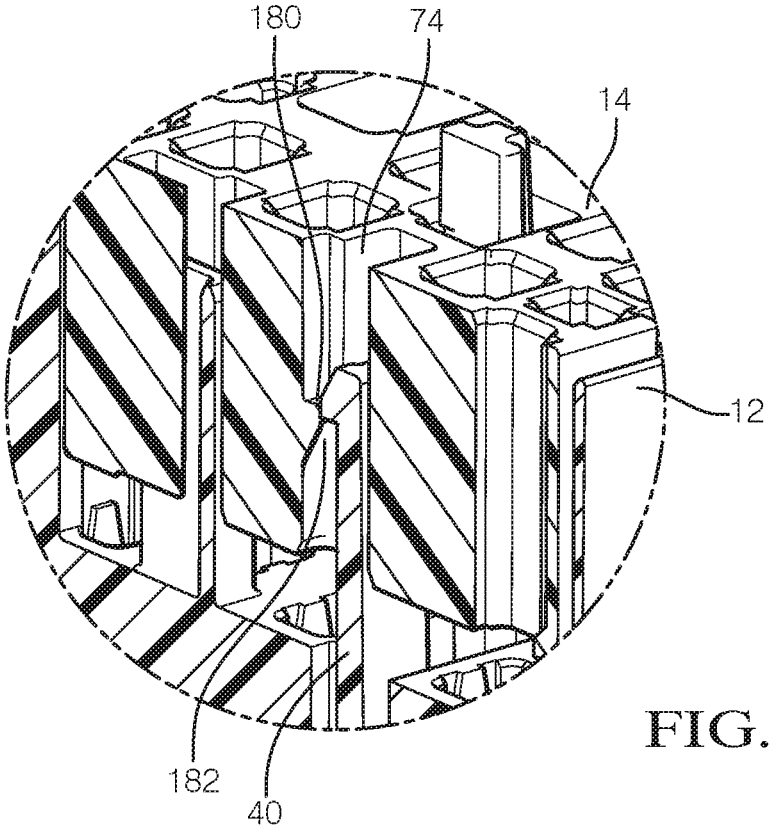
Figure 13C:
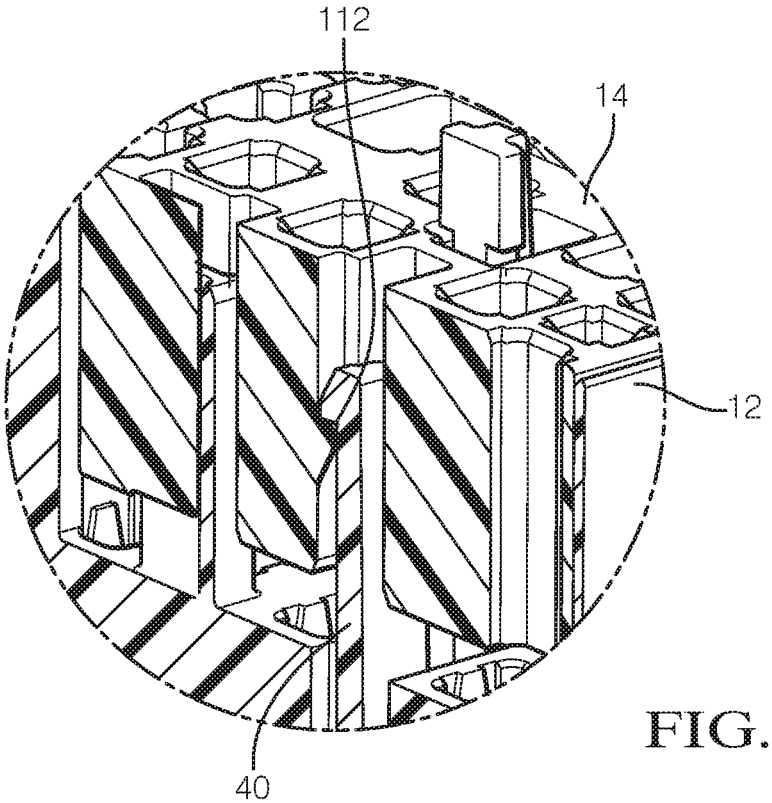

FIGS. 13A-C illustrate deflection of the flexible pre-stage latch posts 40, 42 as the rear housing 14 is inserted into the nosepiece 12. As illustrated, the ends of pre-stage latch posts 40, 42 flex upon contact with a ramp surface 182 until lock surface 112 engages lock surface 180. FIG. 13C illustrates the connector assembly in a pre-stage configuration. Rear housing 14 is temporarily locked in position and prevented from being withdrawn from nosepiece 12 by interaction of lock surfaces 112, 82.

Figure 14A:
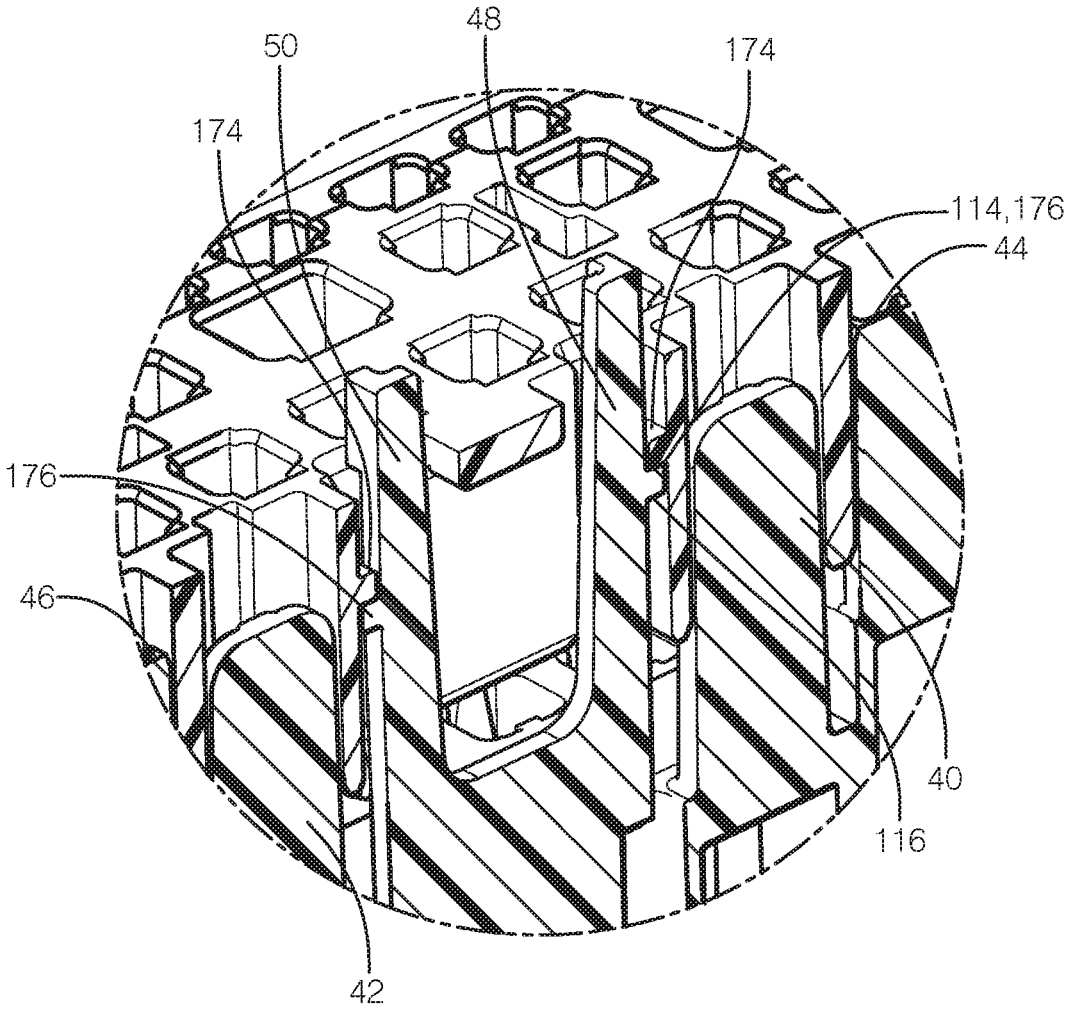
FIGS. 14A, B, C, are detailed views of a portion of the connector assembly of FIG. 1 according to some embodiments.
Figure 14B:
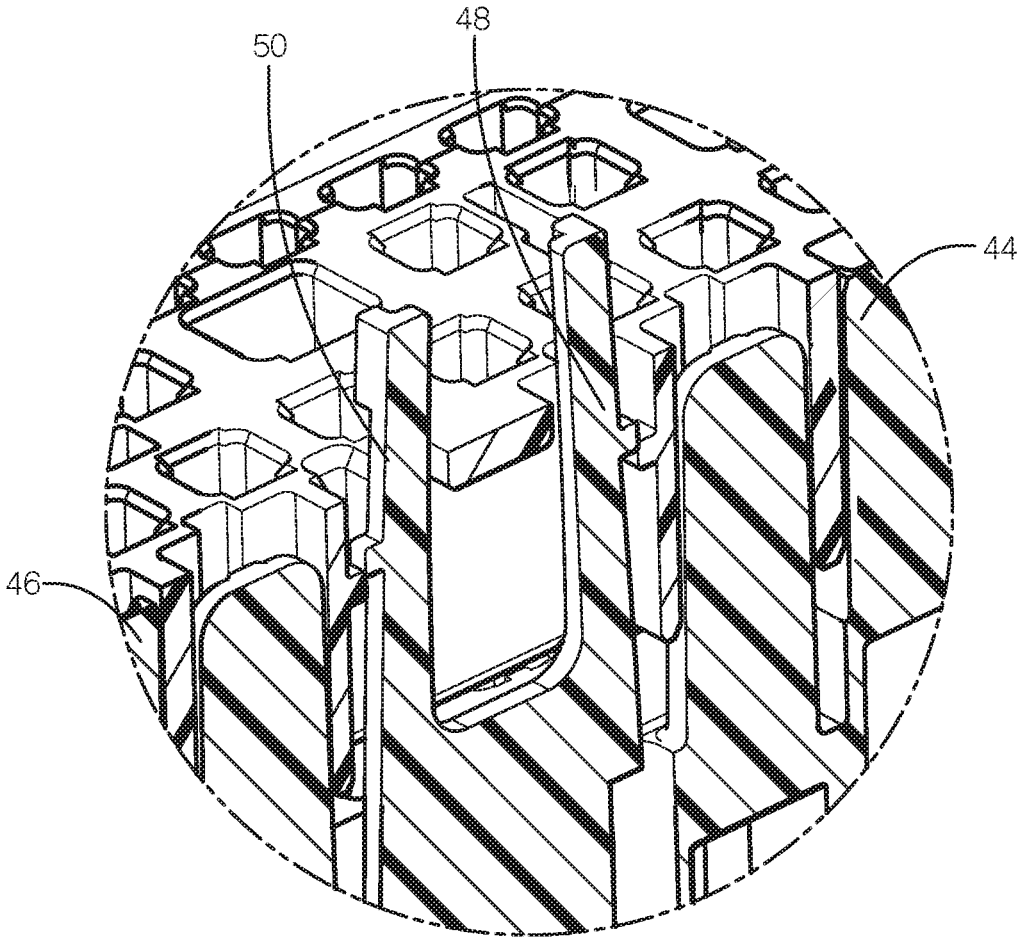
Figure 14C:
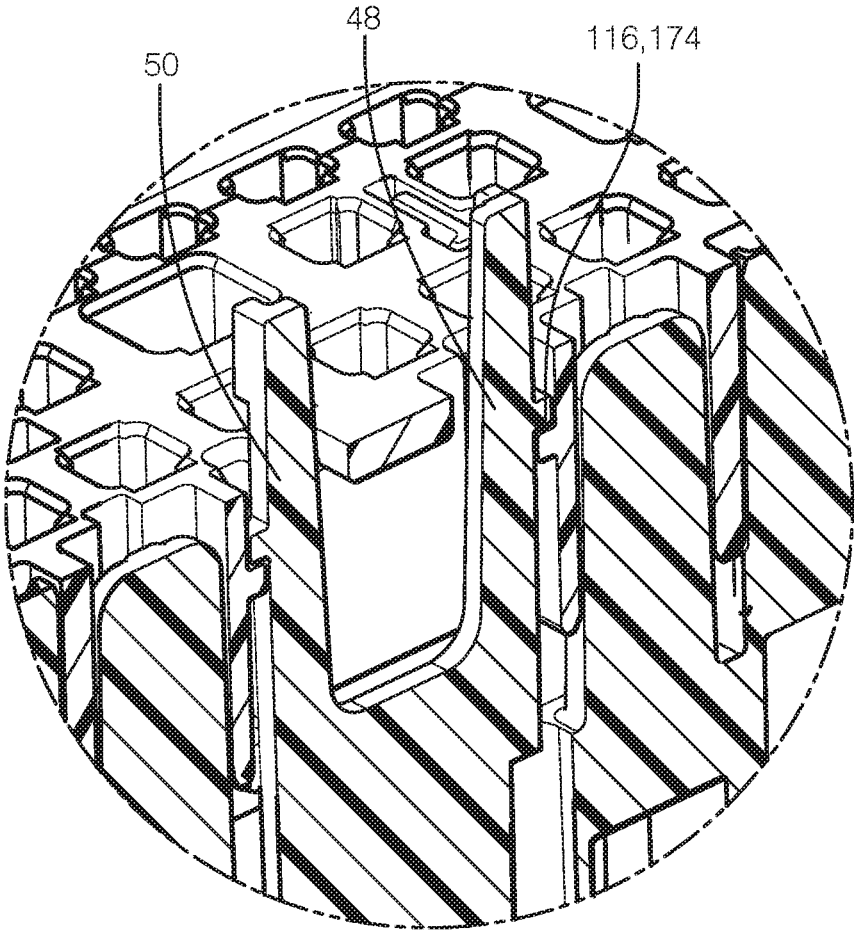

FIGS. 14 A-C illustrate transition of the flexible lock posts 48, 50 between pre-stage configuration and final stage configuration. FIG. 14A illustrates lock post 48, 50 in pre-stage configuration. Lock posts 48, 50 prevent further insertion of the rear housing 14 into the nosepiece 12 as lock surfaces 114 engage lock surfaces 176 on rear housing 14. FIG. 14B depicts lock posts 48, 50 as being biased together to release contact of locks surfaces 114, 176. When lock posts 48, 50 are biased together, the rear housing 14 can be further inserted into the nosepiece 12 toward the final-lock configuration as shown in FIG. 14C. In the final-lock configuration, the lock surfaces 116, 174 engage each other to lock the rear housing 14 into the nosepiece 12.

As described, relative translation between nosepiece 12 and rear housing 14 is controlled by the interaction of cam posts 92 and cam tracks 100 and lock surfaces on pre-stage latch posts 40, 42 and lock posts 48, 50. Initially the rear housing 14 is constrained in the mating direction (longitudinal) as the cam posts 92 enters and tracks along the cam tracks 100. As described, rear housing 14 is held in a pre-lock configuration by contact between lock surfaces 112 of pre-stage latch post 40 and lock surfaces 180 on rear housing 14. In the pre-lock configuration, bays 70 of rear housing 14 are generally aligned with bays 32 on nosepiece 12 and locking feet 160 of the rear housing 14 are offset relative to the nosepiece bays 32. Wire terminals 16 can then be inserted into the bays 32, 70. Proper insertion of terminals 16 results in the mating ends 130 of terminals 16 to contact the stop surfaces 120 of the nosepiece 12. Improperly positioned terminals 16 that do not initially seat against stop surfaces 120 are later biased into position by rear housing 14 by action of the locking feet 160 contacting these terminals and biasing them into position to provide a terminal position assurance feature.

Figure 15:
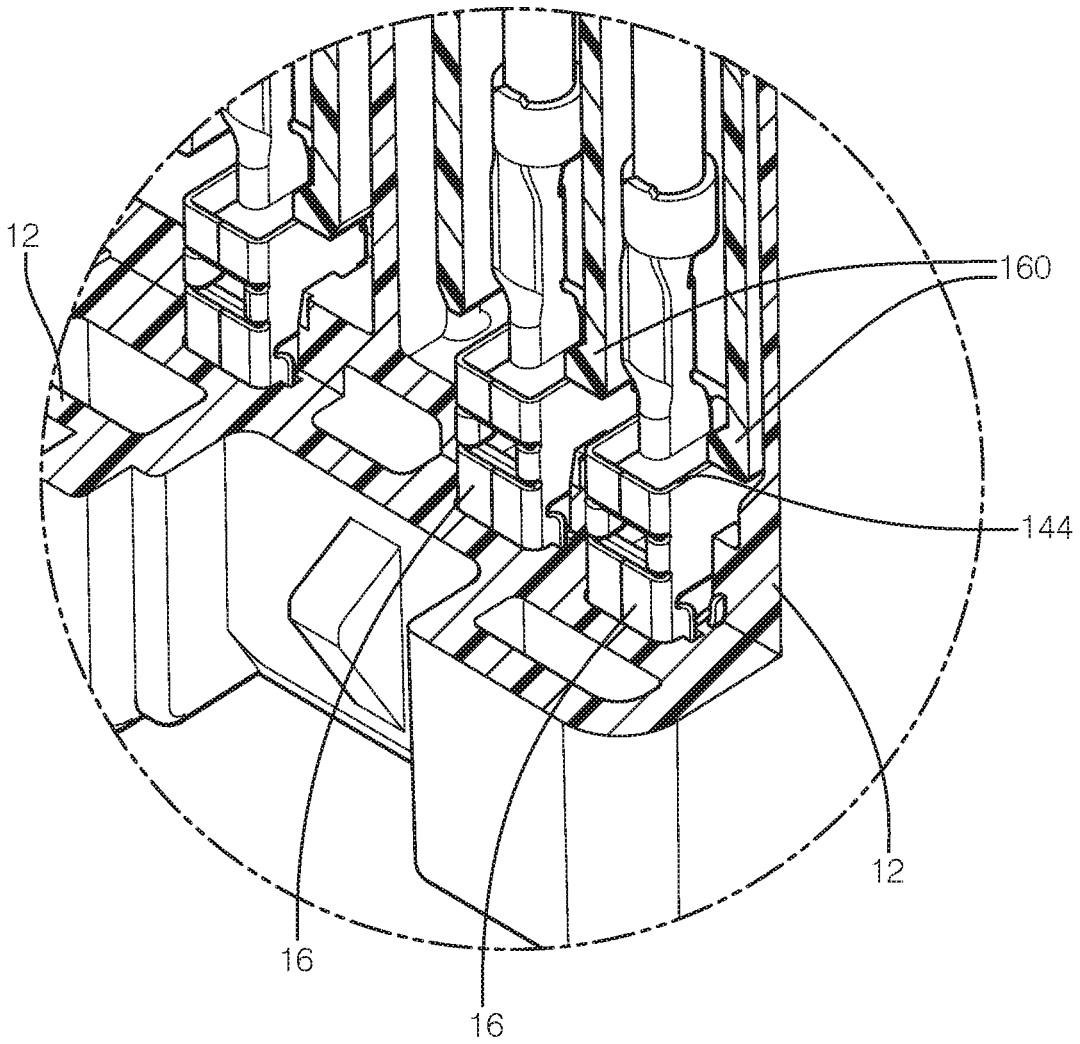
FIG. 15 is a detailed view of a portion of the connector assembly of FIG. 1 according to some embodiments.

FIG. 15 illustrates a pair of partially loaded terminals 16 being contacted by locking feet 160 of rear housing 14. As rear housing 14 is further inserted into the nosepiece 12 the locking feet 160 push against terminal surface 144 to force the terminals 16 toward proper engagement thereby providing a position assurance feature. In the final stage configuration, locking feet 160 provide a secondary lock feature that prevents removal of terminals 16 in response to extraction forces. In the event of wire terminal servicing, the connector assembly can transition from a locked configuration to pre-stage configuration where the wire terminals can be extracted. Lock posts 48, 50 are actuated to release locking surfaces and positioning tabs 94 can be used to retract the rear housing 14 back through the cam track 100 and thereby release locking feet 160 from contact with the wire terminals 16.

Figure 17:
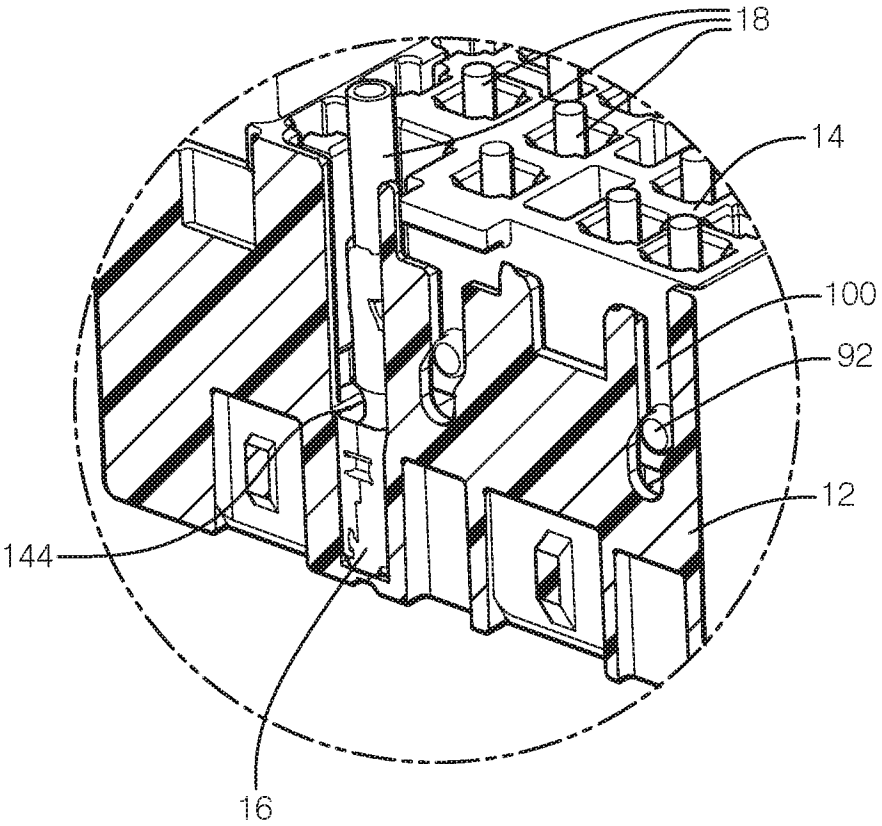
FIG. 16-17 depict the connector assembly components in a pre-stage configuration.
Figure 16:
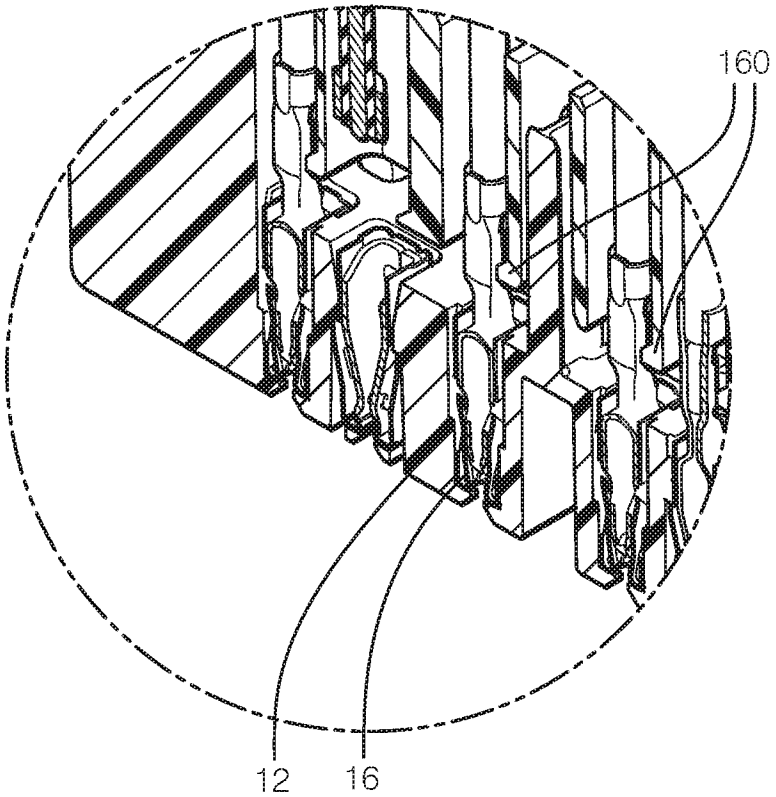
Figure 19:
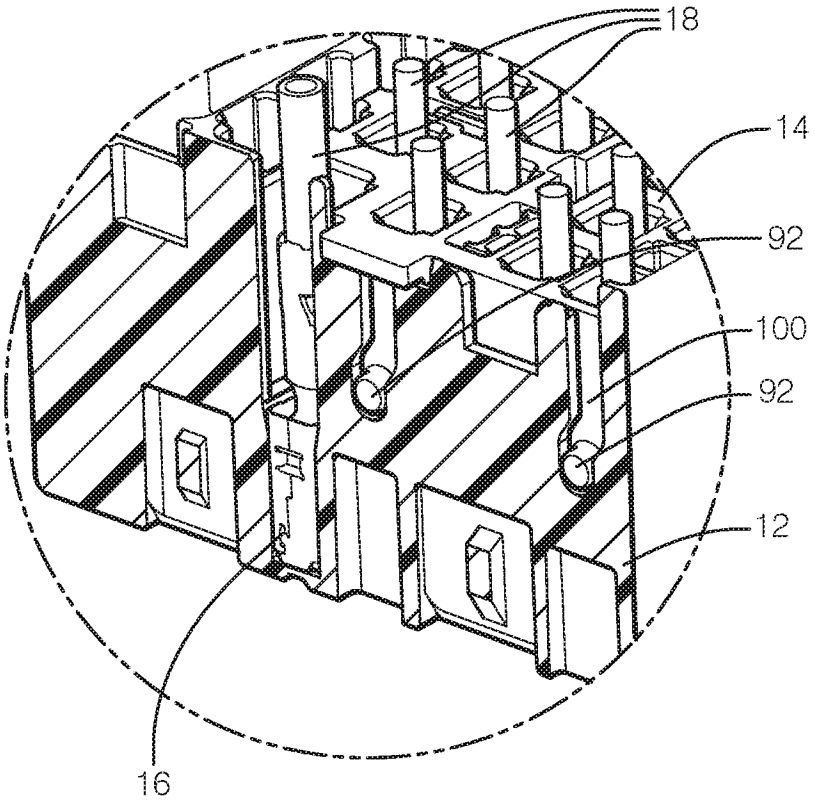
FIGS. 18-19 depict the connector assembly components in a locked configuration.
Figure 18:
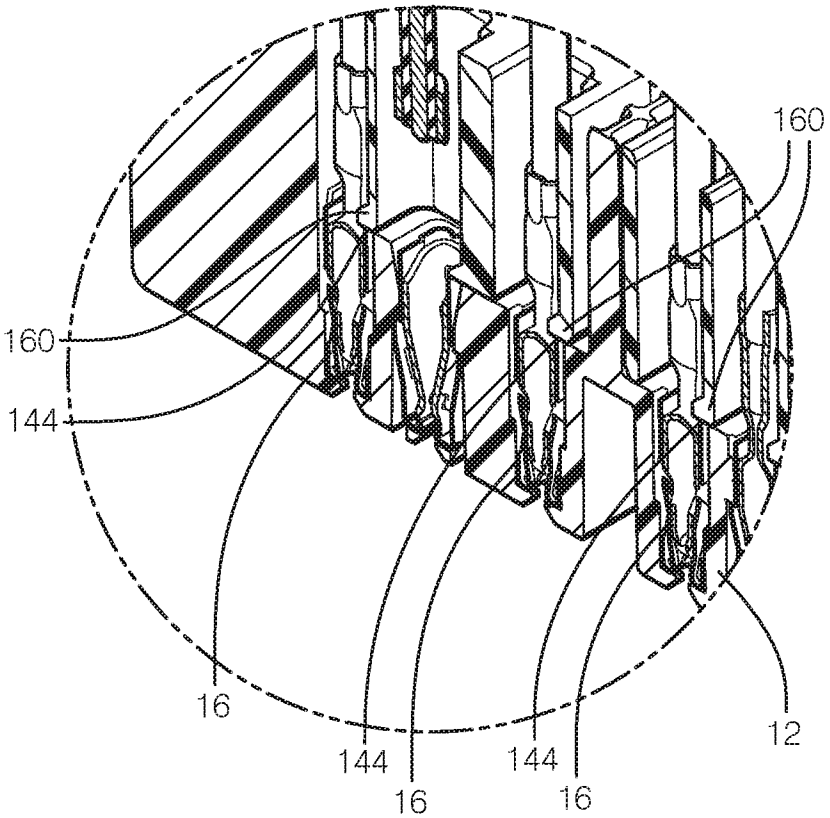

FIGS. 16 and 17 illustrates the connector assembly in a pre-stage configuration with the locking feet 160 of rear housing 14 being offset from the nosepiece terminal bays 32 to allow insertion of wire terminals 16 without interference. FIGS. 18 and 19 illustrate the connector assembly in a locked configuration where the locking feet 160 having transitioned both in the mating direction and orthogonal direction to engage locking surfaces 144 of the terminals.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Discussion of Possible Embodiments

The following are non-exclusive descriptions of possible embodiments of the present invention.

According to one aspect, a connector assembly includes a nosepiece having a body defining a plurality of wire terminal bays, and a rear housing having a plurality of wire terminal bays, with the rear housing engaging the nosepiece along at least one cam track between a pre-lock configuration and a locked configuration, wherein in the pre-lock configuration with the rear housing partially inserted into the nosepiece, the wire terminal bay's of the nosepiece and the wire terminal bay's of the rear housing are aligned to allow insertion of wire terminals, and wherein in the locked configuration the rear housing is further inserted into the nosepiece resulting in both longitudinal displacement and orthogonal displacement of the rear housing relative to the nosepiece.

The connector assembly of the preceding paragraph can optionally include, additionally and/or alternatively any, one or more of the following features, configurations and/or additional components.

For example, the connector assembly may provide a foot within one of the plurality of wire terminal bays of the rear housing, wherein the foot engages an improperly positioned wire terminal as the rear housing transitions to the locked configuration.

In some embodiments, the connector assembly may provide that the foot continues to engage the wire terminal when the connector assembly is in the locked configuration, with the foot providing a secondary lock feature to prevent pull-out of the wire terminal from the connector assembly.

In some embodiments, the connector assembly foot engages the wire terminal at a biasing/locking surface positioned between a mating end and a wire terminating end of the wire terminal.

In some embodiments, the connector assembly may utilize a plurality of flexible posts on the nosepiece that engage with the rear housing.

In some embodiments, the connector assembly may include a rear housing having a plurality of bays for receiving the plurality of flexible posts of the nosepiece.

In some embodiments, the connector assembly may be configured such that the plurality of flexible posts includes at least one pre-stage latch post adapted to maintain the rear housing and nosepiece in the pre-lock configuration.

In some embodiments, the connector assembly may be configured such that the plurality of flexible posts includes at least one lock post adapted to maintain the rear housing and nosepiece in the locked configuration.

In some embodiments, the connector assembly may include a lock post that is accessible rearward of the rear housing to allow release of the at least one lock post and transition between the pre-lock configuration and locked configuration.

In some embodiments, the connector assembly may include at least one cam track located on the nosepiece.

In some embodiments, the connector assembly may include a rear housing with at least one cam post which engages the at least one cam track of the nosepiece. In some embodiments, the connector assembly may include a pair of cam posts positioned on opposite sides of the rear housing.

According to another aspect, a connector assembly includes a nosepiece having a plurality of wire terminal bays, and a rear housing having a plurality of wire terminal bays, with the rear housing engaging the nosepiece along at least one cam track, wherein in a pre-lock configuration the wire terminal bays of the nosepiece and rear housing are generally aligned to allow insertion of wire terminals into the wire terminal bays, and wherein a locked configuration is attained by further inserting the rear housing into the nosepiece in a mating direction with the rear housing traversing in a direction orthogonal to the mating direction so that a portion of the rear housing blocks the wire terminal from removal.

The connector assembly of the preceding paragraph can optionally include, additionally and/or alternatively any, one or more of the following features, configurations and/or additional components.

For example, the connector assembly may provide a rear housing that engages an improperly positioned wire terminal as the rear housing transitions to the locked configuration.

In some embodiments, the connector assembly may include a foot positioned in one of the wire terminal bays that engages one of the wire terminals when the connector assembly is in the locked configuration, with the foot providing a secondary lock feature to prevent pull-out of the wire terminal from the connector assembly.

In some embodiments, the connector assembly may include a foot that engages the wire terminal at a biasing/locking surface positioned between a mating end and a wire terminating end of the wire terminal.

In some embodiments, the connector assembly may include a plurality of flexible posts on the nosepiece that engage with the rear housing.

In some embodiments, the connector assembly may include a rear housing having a plurality of bays for receiving the plurality of flexible posts of the nosepiece.

In some embodiments, the connector assembly may include a pre-stage latch post adapted to maintain the rear housing and nosepiece in the pre-lock configuration. In other embodiments, the connector assembly of claim may include a lock post adapted to maintain the rear housing and nosepiece in the locked configuration.

In some embodiments, the connector assembly may include a lock post accessible rearward of the rear housing to allow release of the at least one lock post and transition between the pre-lock configuration and locked configuration.

In some embodiments, the connector assembly may include at least one cam track located on the nosepiece.

In some embodiments, the connector assembly may include a cam post which engages at least one cam track of the nosepiece.

According to another aspect, a method connecting together a plurality of wires with a connector assembly, including inserting a rear housing into a cavity of a nosepiece to align wire terminal bays of the rear housing with wire terminal bays of the nosepiece, inserting wire terminals into the wire terminal bays, further biasing the rear housing into the nosepiece in a mating direction, and as the rearing housing further enters the nosepiece in the mating direction, camming the rear housing in a direction orthogonal to the mating direction into a locked configuration blocking removal of the wire terminals from the nosepiece.

The method of the preceding paragraph can optionally include, additionally and/or alternatively any, one or more of the following features, configurations and/or additional components.

In some embodiments, the method can further include locking the rear housing and nosepiece in a pre-lock configuration with at least one flexible post of the nosepiece engaging the rear housing.

In some embodiments, the method can further include locking the rear housing and nosepiece in the locked configuration with at least one flexible lock post of the nosepiece engaging the rear housing.

In some embodiments, the method can further include that a lock post also locks the nosepiece and rear housing together in a pre-lock configuration.

In still other embodiments, the method can include that as the rear housing further enters the nosepiece and is cammed in the orthogonal direction, the rear housing engages any improperly positioned wire terminals and biases the terminals into position.

The invention claimed is:

1. A connector assembly comprising:

a nosepiece having a body defining a first plurality of wire terminal bays;

a single piece rear housing having a second plurality of wire terminal bays, with the rear housing engaging the nosepiece along at least one cam track between a pre-lock configuration and a locked configuration; and a foot within one of the second plurality of wire terminal bays of the rear housing, wherein the foot engages an improperly positioned wire terminal as the rear housing transitions to the locked configuration, wherein the foot is displaced longitudinally and orthogonally as the rear housing transitions to the locked configuration, wherein in the pre-lock configuration with the rear housing partially inserted into the nosepiece, the first plurality of wire terminal bays of the nosepiece and the second plurality of wire terminal bays of the rear housing are aligned to allow insertion of wire terminals, and wherein in the locked configuration the rear housing is further inserted into the nosepiece resulting in both longitudinal displacement and orthogonal displacement of the rear housing relative to the nosepiece so as to block removal of the wire terminals from the connector assembly.

2. The connector assembly of claim 1 wherein the foot continues to engage the wire terminal when the connector assembly is in the locked configuration, with the foot providing a secondary lock feature to prevent pull-out of the wire terminal from the connector assembly.

3. The connector assembly of claim 2 wherein the foot engages the wire terminal at a biasing/locking surface positioned between a mating end and a wire terminating end of the wire terminal.

4. The connector assembly of claim 1 further comprising a plurality of flexible posts on the nosepiece that engage with the rear housing.

5. The connector assembly of claim 4 wherein the rear housing includes a plurality of bays for receiving the plurality of flexible posts of the nosepiece.

6. The connector assembly of claim 5 wherein the plurality of flexible posts includes at least one pre-stage latch post adapted to maintain the rear housing and the nosepiece in the pre-lock configuration.

7. The connector assembly of claim 5 wherein the plurality of flexible posts includes at least one lock post adapted to maintain the rear housing and the nosepiece in the locked configuration.

8. The connector assembly of claim 7 wherein the at least one lock post is accessible rearward of the rear housing to allow release and transition between the pre-lock configuration and the locked configuration.

9. The connector assembly of claim 1 wherein the at least one cam track is located on the nosepiece.

10. The connector assembly of claim 1 wherein the rear housing includes at least one cam post which engages the at least one cam track of the nosepiece.

11. The connector assembly of claim 10 wherein the at least one cam post includes a pair of cam posts positioned on opposite sides of the rear housing.

12. A connector assembly comprising:

a nosepiece having a first plurality of wire terminal bays;

a single piece rear housing having a second plurality of wire terminal bays, with the rear housing engaging the nosepiece along at least one cam track; and a foot positioned in one of the second plurality of wire terminal bays, wherein the foot engages one of the wire terminals when the connector assembly is in a locked configuration, wherein in a pre-lock configuration the first plurality of wire terminal bays of the nosepiece and rear housing are generally aligned to allow insertion of wire terminals into the second plurality of wire terminal bays, and wherein the locked configuration is attained by further inserting the rear housing into the nosepiece in a mating direction with the rear housing also traversing in a direction orthogonal to the mating direction so that a portion of the rear housing blocks the wire terminals from removal.

13. The connector assembly of claim 12 wherein the rear housing engages an improperly positioned wire terminal as the rear housing transitions to the locked configuration.

14. The connector assembly of claim 13 wherein the foot provides a secondary lock feature to prevent pull-out of the wire terminal from the connector assembly, wherein the foot is displaced longitudinally and orthogonally as the rear housing transitions to the locked configuration.

15. The connector assembly of claim 14 wherein the foot engages the wire terminal at a biasing/locking surface positioned between a mating end and a wire terminating end of the wire terminal.

16. The connector assembly of claim 12 further comprising a plurality of flexible posts on the nosepiece that engage with the rear housing.

17. The connector assembly of claim 16 wherein the rear housing includes a plurality of bays for receiving the plurality of flexible posts of the nosepiece.

18. The connector assembly of claim 17 wherein the plurality of flexible posts includes at least one pre-stage latch post adapted to maintain the rear housing and the nosepiece in the pre-lock configuration.

19. The connector assembly of claim 17 wherein the plurality of flexible posts includes at least one lock post adapted to maintain the rear housing and the nosepiece in the locked configuration.

20. The connector assembly of claim 19 wherein the at least one lock post is accessible rearward of the rear housing to allow release of the at least one lock post and transition between the pre-lock configuration and the locked configuration.

21. The connector assembly of claim 12 wherein the at least one cam track is located on the nosepiece.

22. The connector assembly of claim 21 wherein the rear housing includes at least one cam post which engages the at least one cam track of the nosepiece.

* * * * *